United States Patent [19]

Griesbaum et al.

[11] Patent Number: 4,944,556

[45] Date of Patent: Jul. 31, 1990

[54] SUPPORTIVE CHAIR, ADJUSTABLE FOR GROWING WITH A CHILD

[75] Inventors: Theodore J. Griesbaum, Seguin, Tex.; Joan S. Lydic-Mettler, Newark, Del.; Pamela A. Flores, San Antonio, Tex.; Anthony B. Jasek, Eagle River, Ak.; Mary A. Wrzensinski-Conran, San Antonio, Tex.

[73] Assignee: Brighton School Incorporated, San Antonio, Tex.

[21] Appl. No.: 240,214

[22] Filed: Sep. 6, 1988

[51] Int. Cl.[5] ..... A47C 7/40; A47C 7/50

[52] U.S. Cl. ..... 297/437; 297/353; 297/466

[58] Field of Search ..... 297/437, 136, 353, 383, 297/183, 466, 464

[56] References Cited

U.S. PATENT DOCUMENTS

| | | | |
|---|---|---|---|
| 1,964,216 | 6/1934 | Sargent | 297/437 |
| 2,461,123 | 2/1949 | Miller | 297/437 X |
| 2,655,982 | 10/1953 | Christensen | 297/468 X |
| 2,714,924 | 8/1955 | Fischman | 297/437 X |
| 2,767,774 | 10/1956 | Derby | 297/437 X |
| 2,916,598 | 12/1957 | Shone | 297/437 X |
| 3,431,020 | 3/1969 | Tyndall | 297/468 X |

*Primary Examiner*—Peter R. Brown

*Attorney, Agent, or Firm*—Cox & Smith Incorporated

[57] ABSTRACT

A chair having an adjustable backrest, an adjustable footrest, and side panels which oppose the abduction of a seated individual's body, particularly for supporting and managing the body of a child who has limited muscle control or other developmental difficulties and for growing with that child throughout his development.

1 Claim, 2 Drawing Sheets

SUPPORTIVE CHAIR, ADJUSTABLE FOR GROWING WITH A CHILD

BACKGROUND OF THE INVENTION

The present invention relates to a chair which manages a child and allows for growth and adjunctive therapy of development difficulties. More particularly, the present invention relates to a chair with features which include adjustable members for accommodating children of differing sizes in proper seated positioning.

A child with lack of muscle control encounters great difficulty in maintaining a sitting position. Even when children with those motor problems can be seated on chairs without falling off, their bodies slouch or sink in the chair and their legs naturally spread to an abducted position. Such low muscle tone and lack of muscle control has technically become known as "ligamentous laxity" and is commonly associated with a variety of disorders including Down Syndrome and Cerebral Palsy. Collateral disorders, unfortunately, such as diminished mental development often accompany such disorders. To make matters even more disadvantageous, because of the lack of muscle control, the child's mental development may be indirectly affected as well.

Programs to stimulate cognitive development are most effectively coordinated when children are in a seated position. Therefore, children with postural disorders are hindered in their mental development by not being able to maintain a seated position. Vice versa, children with delayed cognition and other mental disorders often lack the concentration that naturally helps a child pay attention in an instructional setting, and such children also often slouch or rotate in their chairs. Accordingly, instructional assistants must constantly assist the children in maintaining their seated position rather than concentrating on teaching a lesson.

Consequently, due to the constant necessity to aid the children in sitting and the unending distractions that are caused by the aforementioned problems, any positive environment for cognitive development is easily destroyed. Even children who have full mental faculties but are hindered by their physical disorders are at a disadvantage in their learning environment. Furthermore, by encouraging the proper ideal sitting position, the body of a child with poor muscle development is trained to be supported in that position rather than a slouched position. By controlling and managing a child's physical body, therapy can be aided for almost all developmental difficulties. It is, therefore, an object of the present invention to provide an apparatus which maintains the body of a child or other person with such difficulties in a sitting position.

As mentioned, a typical chair is not adequate for controlling the posture of such children. In fact, most modern chairs for classroom use by children have a curved form that even encourages slouching. An ideal posture is encouraged by a chair which is formed by members that meet at right angles with another so that the child's back and lower legs are biased in vertical positions and the child's upper legs are positioned horizontally. This position puts the pelvis in a vertical plane and, therefore, tends to uplift the child's head and allow alertness and thought. To encourage this position, a child's chair must correspond to his particular physical size and proportions. Thus, it is ideal for chairs to be custom built for each child's size and shape so that the optimal learning position for that child can be encouraged by the chair in which the child sits.

Further, it is ideal for the child's feet to be resting on the ground or another horizontal surface to help maintain the position of the pelvis, provide a surface for the child to push against and to discourage swinging of the feet.

In the past, some teachers have managed this problem by placing a box or foot stool beneath a child's seat so that the child may place his feet on the box or foot stool for support. In fact, some prior teachers have even fixed such boxes to the legs of the chairs in order to prevent the boxes from being kicked out from beneath the child's feet. It also is an object of the present invention to provide a means upon which the child's feet may rest for enabling support.

Unfortunately, children vary between one another and also change in size as they grow. Having an assortment of chairs for all sizes helps solve this problem, but can be costly since an oversupply is necessary in order to accommodate every child as the varieties of sizes in a random group would not be predictable. Practically speaking, having such an assortment also presents problems since there are usually not enough adult assistants who can pick out a proper chair for each child, especially when children are difficult to control and it cannot be ensured that a child will stay in a single chair once one has been selected for him. It is, thus, an object of the present invention to provide a chair for managing the posture of children, which chair is adjustable to fit children of a variety of sizes.

Previous patents do disclose seating apparatus with adjustable members, but no such prior art discloses a chair such as one of the Present invention which incorporates particular advantages for supporting a child as the present invention does. Of note, are disclosures corresponding to U.S. Pat. Nos. 2,466,350; 3,761,969; 2,723,788 and 4,082,356; which patents are disclosed as relating to a combined baby's seat and table, an article of furniture having adjustable parts and including a supporting unit adapted to receive a person in sitting or lying conditions, a portable sewing kit having the appearance of a rocking chair, and an educational puzzle chair, respectively.

Accordingly, it can be seen that there is a need for apparatus to overcome the problems enumerated above relating to support means for supporting children with ligamentous laxity. It is toward these objectives that the present invention is directed. Other objects, features and advantages of the present invention will become evident to those skilled in the art in light of the following.

SUMMARY OF THE PRESENT INVENTION

The Present invention is a chair that grows with a developing child while the chair supports and manages the body of the child when the child is positioned seated in the chair. An adjustable backrest and an adjustable footrest enable the chair to be adjusted for accommodating children of differing sizes, thereby enabling the chair to grow with a single child as the child's size changes with age. The present invention also includes other features for supporting and managing the body of the child, including a seat belt strap and side panels which guide the legs of the child so that the legs do not abduct. The chair's seat member and footrest are coplanar members, both being horizontal, and the backrests are positionable in vertical positions, normal to the seat member for encouraging mental alertness in an ideal position of the child. The backrests are adjustable to two edge of the seat member, which front edge tends to be positioned 1–2 inches behind the knee of the child. The footrest also is adjustable to enable four (4) different heights of a surface upon which the child s feet may rest above the ground, the lowest of these heights being that with the footrest removed and stored while the child's feet rest on the ground. The seat member is fixed in relation to the rest of the chair other than the adjustable backrest and the adjustable footrest.

The chair of the present invention also includes means which tend to oppose the abduction of the body, particularly the legs, of the child sitting on the seat member. This means is enabled by side panels which extend above and forward of the seat member in such a manner as to guide the child's legs toward the child's plane of symmetry.

The side panels also provide armrests which can further be used to support a lap board or other instructional materials for use by the child.

Furthermore, the present invention may include storage spaces for placing the adjustable backrest and the footrest when such members are removed from their operative positions for accommodating larger children. The footrest and the adjustable backrest may also include means, such as latches with retractable posts which are outwardly biased into post holes in the side panels of the chairs.

Many other objects, features and advantages of the present invention will become evident to those skilled in the art in light of the following description of the preferred embodiment of the present invention, taken in conjunction with the accompanying figures and the appended claims.

DETAILED DESCRIPTION OF THE PREFERRED EMBODIMENT

Figure 1:
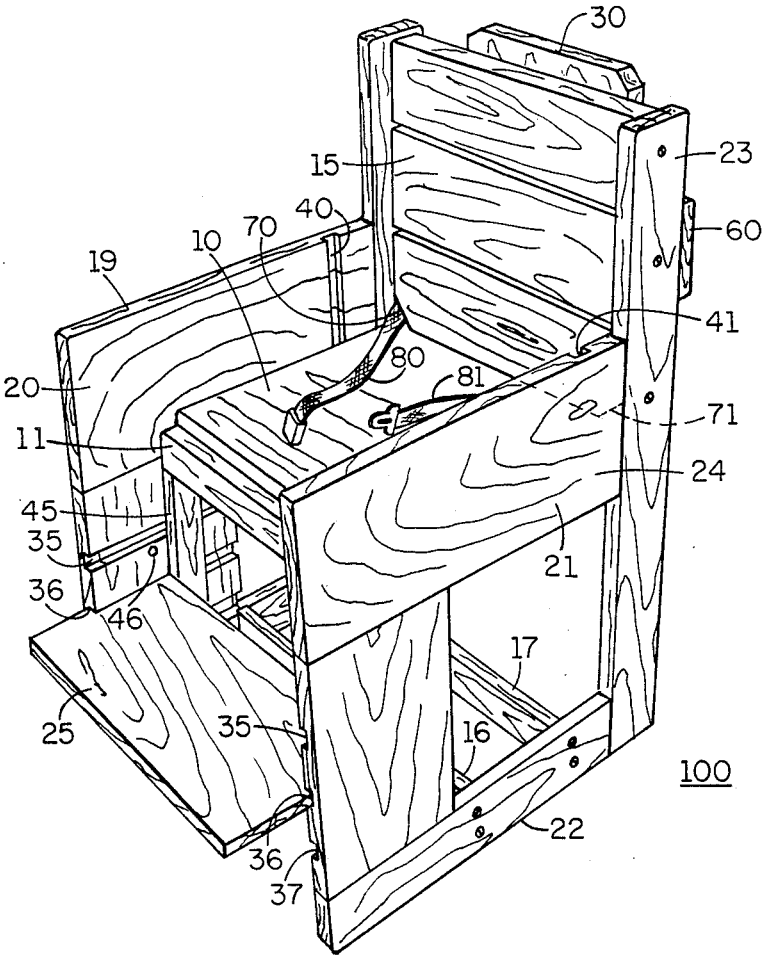
FIG. 1 is a bird's eye perspective drawing of the preferred embodiment of the present invention.

Basically, the embodiment of the present invention is a seat comprised of a seat member 10, stationary backrest 15, and side panels 20 and 21. Seat member 10, stationary backrest 15 and side panels 20 and 21 are rigidly connected by wood glue and a plurality of wood screws (not numbered) to form a seat in which a child may sit. The preferred embodiment is laterally symmetrical about a plane of symmetry (not shown) which is coplanar with and equidistant from side panels 20 and 21. Struts 16 and 17 are provided, rigidly connected between side panels 20 and 21, for reinforcing the strength of the embodiment. Seat member 10 has an upper surface which is planar and which is positioned horizontally during ordinary use. Side panels 20 and 21 each have a lower edge 22 which ordinarily rests on a horizontal surface 100, such as the ground, although surface 100 does not necessarily have to be horizontal but should be approximately so. Stationery backrest 15 is positioned vertically. Side panels 20 and 21 are identical mirror images of each other, being mirror images about the plane of symmetry of the embodiment.

Side panels 20 and 21 provide a variety of advantages. Each of side panels 20 and 21 are composed of four (4) shape of a "d" ("d" shape most visible in FIG. 4). According to the "d" shape, each of side panels 20 and 21 has an upright section 23 extending from an approximately square-shaped section 24. The upper surfaces 19 of side panels 20 and 21 provide arm rests for an individual sitting on seat member 10. Furthermore, side panels 20 and 21 oppose abduction of the legs of an individual seated on seat 10. This opposition of abduction is particularly enabled by the spacial relationship between seat member 10 and the perimeters of side panels 20 and 21. Side panels 20 and 21 extend forward, beyond the front edge 11 of seat member 10, and also extend upward from seat member 10. These extensions beyond seat member 10 provide means for guiding the legs and body of an individual seated on seat member 10 to prevent the abduction of the individual's body, particularly of the individual's legs.

Figure 3:
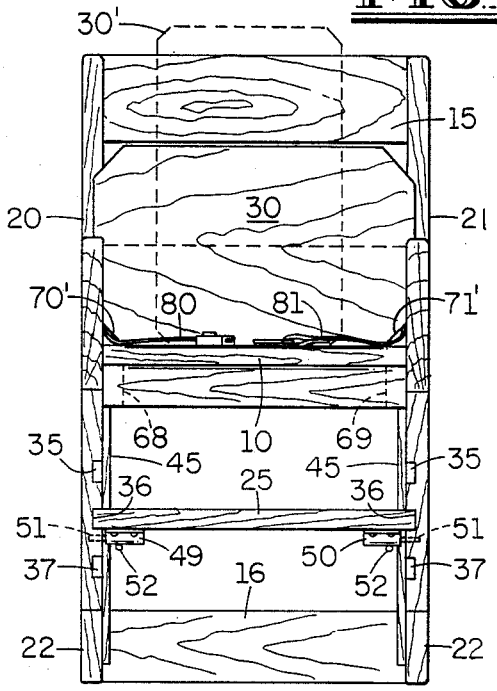
FIG. 3 is a frontal view of the chair in FIG. 1.

Referring to FIG. 3, footrest 25 is provided for supporting the feet (not shown) of an individual seated on seat member 10. Footrest 25 is horizontally positioned in pairs 35 through 37 of oppositely oriented slots, between side panels 20 and 21. Footrest 25 is vertically supported and held in place by slots 35 through 37, and there are three pairs, 35, 36 and 37 of slots for positioning footrest 25 at three different heights corresponding to the heights of slots 35 through 37, respectively. A fourth height at which the feet of an individual seated on seat 10 may be supported is provided by removing footrest 25 from within pairs 35 through 37 of slots in order to allow the individual's feet to rest on the floor surface 100. When so removed from pairs of slots 35 through 37, footrest 25 may be stowed in its stowed position in space 85 (shown by hidden lines in FIG. 4) formed within any of the pairs 35 through 37 of slots, footrest 25 is further held in place by stops 45 and latches 49 and 50. Stops 45 are rigidly connected to the insides of each of side panels 20 and 21 beneath seat member 10, and stops 45 are positioned vertically. Stops 45 are positioned to limit the rearward movement of footrest 25 within pairs of slots 35 through 37 beyond the forwardmost edges of stops 45.

Figure 6:
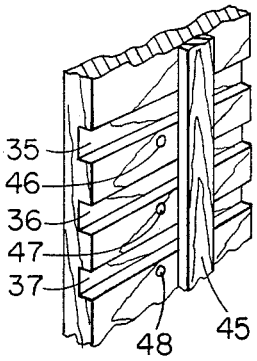
FIG. 6 is a detailed view of the post holes by which posts prevent the footrest of the chair form sliding.
Figure 5:
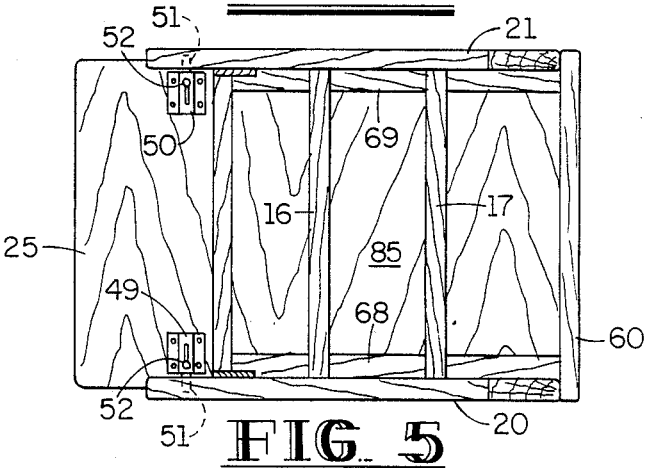
FIG. 5 is a view from the bottom of the chair in FIG. 1.

Additionally, latches 49 and 50 secure footrest 25 to side panels 20 and 21. Latches 49 and 50 are identical and are of the standardly available type which has a retractable post 51 (shown in hidden line in FIG. 5) which are spring biased outward from the rest of each of latches 49 and 50, but which may be retracted to within the rest of latches 49 and 50 by manually sliding knob 52 (numbered in FIG. 5). Latches 49 and 50 are mounted to the underside of footrest 25. When footrest 25 is operatively positioned within any Pair 35 through 37 of slots in its rearwardmost position against stop 45, the retractable posts 51 of latches 49 and 50 are able to be biased outwardly into post-holes 46 through 48 (shown in FIG. 6) which correspond with pairs of slots 35 through 37, respectively. Thus, when posts 51 are biased into either pair of post holes 46 through 48, footrest 25 is prevented from sliding forwardly within and from any pair 35 through 37 of slots. Note that such forward sliding would otherwise be possible by the feet of an individual sitting on seat member 10 if such individual were figiting his feet (not shown).

Figure 2:
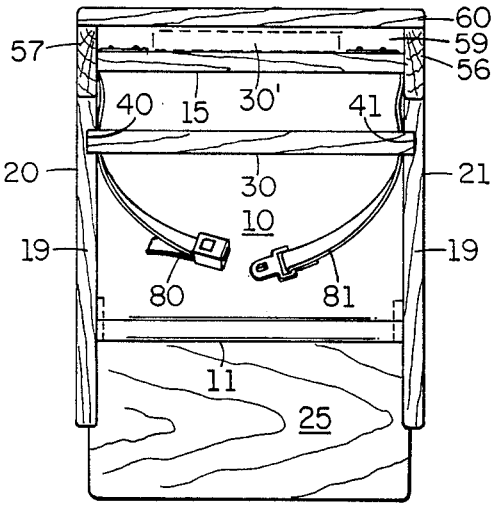
FIG. 2 is a view from above of the chair in FIG. 1.
Figure 4:
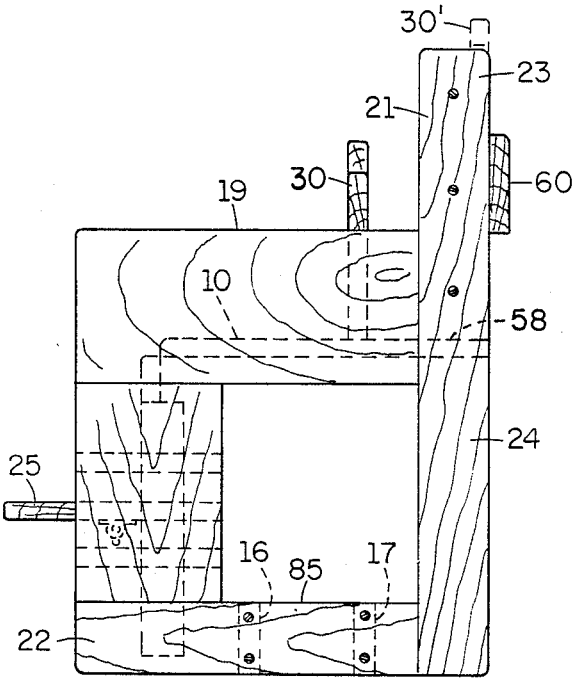
FIG. 4 is a view from the side of the chair in FIG. 1.

Referring now to FIGS. 2 through 4, adjustable backrest 30 is a vertically positioned member which provides a backrest for an individual seated on seat member 10. Adjustable backrest 30 is positioned parallel to stationary (shown in solid lines) and in a stored position 30' (shown in hidden line). Adjustable backrest 30 is slideably engaged in a pair of slots 40 and 41 in side panels 20 and 21, respectively. When adjustable backrest 30 is not operatively positioned within slots 40 and 41, it may be stored in a storage slot 59 provided by cross member 60, and an individual seated on seat 10 may rest his back against permanent backrest 15. Accordingly, adjustable backrest 30 and stationary backrest 15 provide means for accommodating differently sized individuals seated on seat member 10 by enabling a backrest at an adjustable distance from frost edge 11 of seat 10. For purposes of further description of the present invention, "the backrest" refers to the combination of stationary backrest ("first member ") 15 and adjustable backrest ("second member ") 30. The configuration of the backrest when adjustable backrest 30 is operatively positioned in slots 40 and 41 is referred to as the "second configuration " of the backrest, and configuration of the backrest when adjustable backrest 30 is stored elsewhere than in slots 40 and 41 is referred to as the "first configuration" of the backrest.

Storage slot 59 is a slot formed between cross member 60, stationary backrest 15, a rearwardly extending part 58 (shown in hidden line in FIG. 4) of seat member 10, and rearwardly extending portions 56 and 57 of side panels 21 and 20, respectively. Adjustable backrest 30 is thus stored as in the position shown in solid line in FIG. 1 and in hidden line in FIGS. 2 through 4. When adjustable backrest 30 is stored within storage slot 59, stationary backrest 15 provides a backrest for accommodating an individual which is larger than an individual accommodatable by adjustable backrest 30 since stationary backrest 15 is further rearward from the front edge 11 of seat member 10 than are slots 40 and 41. The force of gravity tends to rest adjustable backrest 30 against the upper surface of seat member 10 regardless of whether it is in the operative position (as shown in solid line in FIGS. 2 through 4 or in the stored position (as shown in hidden line. Upwardly positioned portions (not numbered) of adjustable backrest 30 are oriented relative to the rest of the preferred embodiment such that it may be easily gripped to enable removal from either the operative or the stored position.

Spaces 70 and 71 (indicated in FIG. 1) are triangular shaped spaces formed at the lower corners of stationary backrest 15 between stationary backrest 15, and side panels 20 and 21 and seat member 10. Similar triangular spaces 70' and 71' (shown in FIG. 3) are formed between adjustable backrest 30, side panels 20 and 21 and seat 10 when adjustable backrest 30 is in its operative position. Seat belt sections 80 and 81 are thread through spaces 70 and 70', and 71 and 71', respectively, in order to provide an additional means for holding an individual seated on seat 10 with his back against one of the back rests 30 or 15 appropriately. Sections 80 and 81, when joined together around a person, also prevent the person from leaving seat 10. Fixed ends (not numbered) of seat belt sections 80 and 81 are secured to the back surface of stationary backrest 15.

Block supports 68 and 69 are rigidly connected to side panels 20 and 21, respectively, and are also rigidly connected to the underside of seat member 10 for providing additional support of seat member 10 to reinforce the strength of the chair for supporting an individual seated on seat member 10.

The overall structure of the chair of the preferred embodiment tends to bias the body of a person seated thereon in a position ideal for mental development while managing the person's body and even providing physical therapy for a person with lack of muscle control.

Thus, the chair of the preferred embodiment is capable of accommodating persons of varying sizes and accommodating so in a way as to therapeutically manage the body of the development but also the mental development of the child or other person.

Because of the ability to accommodate persons of a variety of sizes, the chair is capable of adjusting with a single child's body as the child grows. Accordingly, the chair as a whole is said to grow with the child, managing the child's body through years of development. While at first a very small, young child sits in the chair with adjustable backrest 30 in slots 40 and 41 and with footrest 25 in pair of slots 35, backrests 30 may be removed and the position of footrest 25 may be adjusted as the child grows. Such adjustments continue for a growing child until the feet of the child rest on the floor 100 and the back of the child rests against stationary back rest 15 at which point no larger adjustments can be easily made.

An alternative embodiment (not shown) of the present invention is identical to the preferred embodiment but incorporates additional latches mounted to the rearside of adjustable back rest 30 with posts biased into post holes in side panels 20 and 21 for securing adjustable back rest 30 in the operative position. Such securing is similar to that of footrest 25 in the preferred embodiment, and it particularly is useful for accommodating a hyperactive child who otherwise might force backrest 30 upward in and out of slots 41 and 42 by tugging on belts 80 and 81.

Although the present invention has been described in conjunction with the foregoing specific embodiment, it is not intended that such specifications limit at all the scope of the present invention, but rather it is intended that the many embodiments of the appended claims, including those embodiments which are obvious to one of ordinary skill and those which are equivalent be encompassed by this invention.

We claim:

1. An apparatus for supporting a person's body in a normal sitting position, comprising:

a seat member for supporting said person, said seat member having a forwardmost edge, a first lateral edge, and a second lateral edge, such that the knees of said person rest beyond said forwardmost edge;

a means for limiting abduction of the legs of said person comprising a first panel connected to said first lateral edge of said seat and a second panel connected to said second lateral edge such that the forwardmost edge of the seat is rearward of the forward edges of the first and second panels said first panel having a first slot and said second panel having a second slot , said slots extending upwardly from a rear portion of said seat member ;

a backrest for holding the back of said person in a substantially upright position, said backrest being selectively positionable in either a first configuration or a second configuration relative to said seat member, said backrest comprising a first member and a second member, said first member rigidly connected between said first and second panels and rearwardly of said opposing slots said second member adjustable relative to said seat member, said second member received slidably in said first slot and said second slot to define said second configuration;

a handle mounted to and extending between the first and second panels and to the rear of said backrest, said handle forming a third slot between said backrest and said handle for receiving said second member therein when said backrest is positioned in said first configuration; and a footrest for limiting movement of the lower portions of the legs of said person, said footrest being connected between the first and second panels by a further plurality of opposed slots, said further plurality of opposed slots being vertically spaced so in such a manner as to enable the adjustment of the height of said footrest relative to the height of said forwardmost edge of said seat member.

* * * * *